United States Patent [19]

Musacchia

[11] 4,164,095

[45] Aug. 14, 1979

[54] EMERGENCY ESCAPE WALL STRUCTURE

[76] Inventor: John Musacchia, P.O. Box 452, Marathon, Fla. 33050

[21] Appl. No.: 901,448

[22] Filed: May 1, 1978

[51] Int. Cl.[2] ..... B24B 25/00

[52] U.S. Cl. ..... 52/1; 49/1; 49/131; 49/141; 52/69; 182/19; 292/21; 292/177

[58] Field of Search ..... 52/1, 29, 69; 49/131, 49/141, 1, 5-7, 70; 292/21, 177; 182/19, 34, 36

[56] References Cited

U.S. PATENT DOCUMENTS 4,024,928 5/1977 Pickard ..... 52/1

*Primary Examiner*—J. Karl Bell

[57] ABSTRACT

An emergency escape wall structure actuated either by pressure against the wall or automatically actuated by the presence of heat, smoke, gas, or oxygen deficiency detectors or push buttons, any one of which actuates the automatic means or by a hand lever which manually opens the structure. Upon actuation, an escape panel falls outwardly and downwardly creating a massive opening to permit the escape of a large number of persons in a brief time period.

10 Claims, 7 Drawing Figures

EMERGENCY ESCAPE WALL STRUCTURE

BACKGROUND OF THE INVENTION

As is well known with serious fires and explosions, many lifes have been unnecessarily lost merely because there was an inadequate escape exit available immediately to exit a large number of people. Various devices relating generally to escape means have been shown in the prior art, such as:

| Inventor | Patent Number |
|---|---|
| Burnette | 3,120,032 |
| Gilbert | 3,445,963 |
| Coulter | 3,777,423 |
| Zawadzki | 3,854,763 |
| Kinney | 3,861,739 |
| Coulter | 3,905,063 |
| Lirette | 4,005,886 |

None of these patents, however, provides a massive opening for the escape, in a brief time, of a large number of people as has been necessary in places where there are large gatherings such as nightclubs, meeting halls, auditoriums and stadiums. Although such facilities frequently have a multiplicity of exits, when immediate evacuation is essential, the people pile up at the doors where a funneling effect occurs. Such a funneling effect resulting in the trampling of people and in the inability of at least some of the people to escape.

Particularly in nightclubs and auditoriums, one reason why further exits are not provided is to avoid the loss of valuable wall space.

A satisfactory solution to the need for the immediate evacuation of a large number of persons has not been satisfactorily resolved until the emergence of the instant invention.

SUMMARY OF THE INVENTION

In accordance with the present invention, an emergency escape wall is provided which provides for substantial additional exit area in the case of an emergency to alleviate the funneling situation of people that results in an emergency situation when a large number of people try to exit from a structure at the same time. In nightclubs and other places of public assembly, the use of this invention would empty a building in seconds, instead of minutes, thereby saving countless lives. Until needed, the wall structure remains decorative and functional so that valuable wall space is not lost. The emergency escape wall structure is simple to construct and low in cost and saves valuable wall space while providing an additional exit when immediate evacuation is essential.

A wall panel is hinged at its base. A plunger lock is provided with a pointed top surface end to permit opening by physical pressure. The plunger lock is supported by springs whose force may be overcome by persons pressing against the wall. The supporting springs which hold the plunger lock in place may be dropped into wells thereby releasing the plunger lock. Such a dropping of the support springs is actuated by any one of a number of detection devices, such as those detecting heat, smoke, gas or oxygen deficiency. Also a push button or switch may be used to actuate the release mechanism in place of the detection devices. The door may also be manually actuated by a lever.

The novel features which are considered as characteristic of the invention are set forth with particularity in the appendant claims. The invention itself, however, as to its construction and obvious advantages, will be best understood from the following description of the specific embodiment when read with the accompanying drawings.

DETAILED DESCRIPTION

Figure 1:
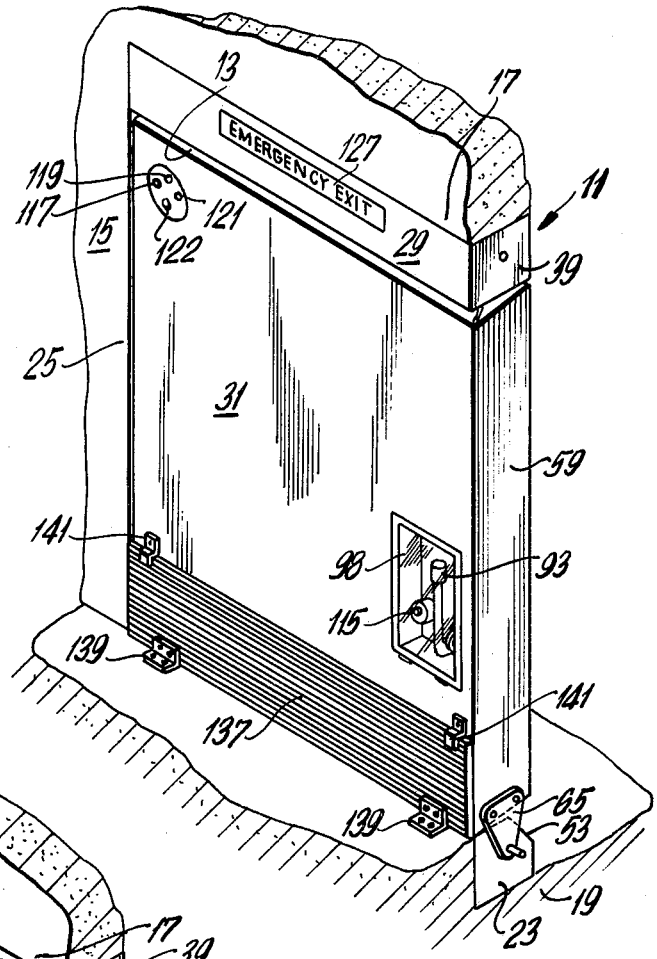
FIG. 1 is a perspective view of the emergency escape wall with the escape panel in a closed position and with the wall of the building partially broken away.
Figure 2:
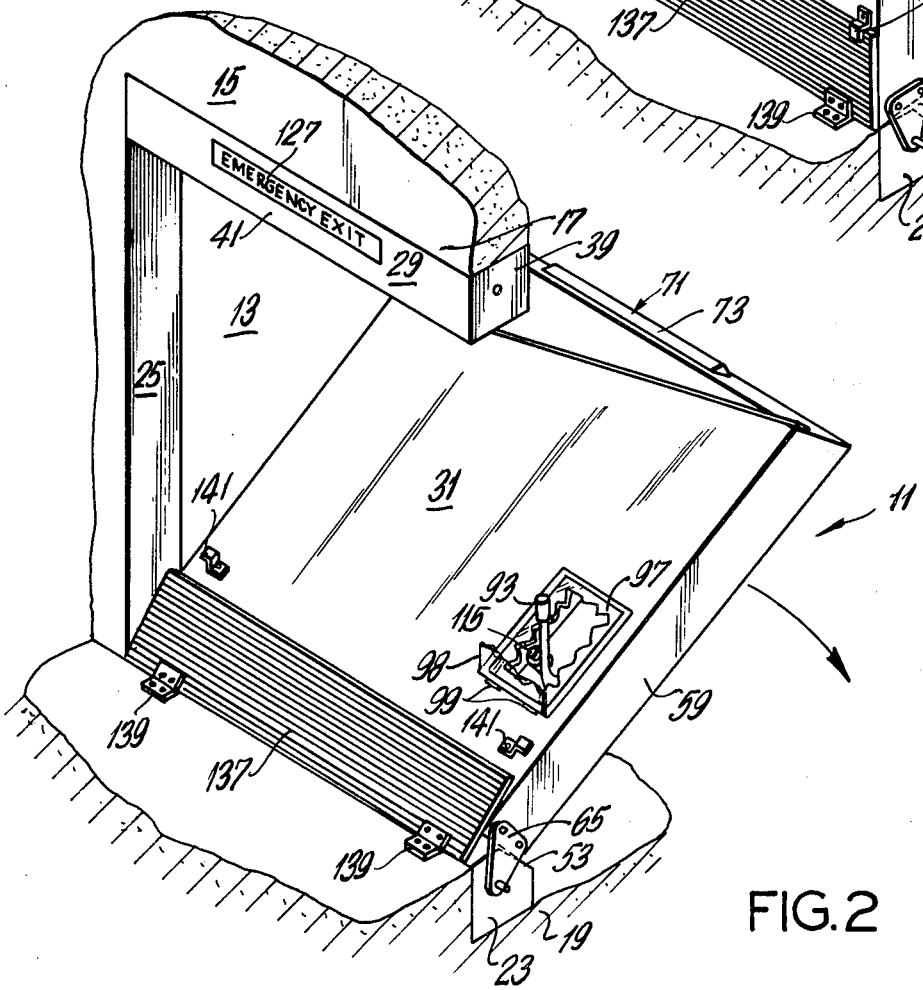
FIG. 2 is a perspective view similar to FIG. 1 but with the escape panel partially open.

The same reference numerals are used throughout the drawings and specification to note a similiar item of the invention. The emergency escape wall structure 11 is mounted within an open space 13 of a fixed outside wall 15 of a building. Above the structure 11, there is a header frame 17 and at the bottom there is a sill frame 19.

The lower area of the emergency escape wall structure 11, there is a bottom panel 23 which is secured in place upwardly from the sill frame 19 and against two side frames 25. The upper area of the emergency escape wall structure 11 includes an upper panel 29 which is rigidly secured between the two side frames 25 and directly beneath the header frame 17. An escape panel 31 is located between the two side frames 25 and the bottom panel 23 and upper panel 29. A major portion of the space between the header frame 17 and the sill frame 19 is enclosed by the escape panel 31.

The bottom panel 23 and upper panels 29 are preferably of a hollow construction. The upper panel 29 includes a top member 33, a bottom member 35, a left side member 37 and a right side member 39. An inside sheet 41 and an outside sheet 43 enclose the upper panel 29. Inner members (not shown) may be provided in the upper panel 29 for added strength.

Similarly, the bottom panel 23 includes a lower member 45, a top member 47, a left side member 49 and a right side member 51. An outside sheet 52 encloses the outside surface bottom panel 23. The inside of the bottom panel 23 rests against the sill frame 19. The top member 47 of the bottom panel 23 has a bevel 53. The bevel 53 is enclosed by a bevel member 54. The bevel 53 permits the escape panel to fall downwardly and outwardly without obstruction. Inner members (not shown) may be provided in the bottom panel 23 for added strength.

The escape panel 31 is also hollow to provide space for the various parts to be explained hereinafter. However, support members 55 are utilized to strengthen the escape panel 31 while supporting and guiding the various parts hereafter described. The escape panel 31 has a top member 56, a bottom member 57, a left side member 58 and a right member 59. An outside sheet 61 and an inside sheet 63 enclose the escape panel 31.

A triangular-shaped plate 65 is fixedly mounted to the escape panel 31 on each of the side members 58, 59 of the escape panel 31 adjacent the bottom member 57 by means of a pair of screws 67. The triangular-shaped plate 65 is pivotably mounted in the bottom panel 23 on each side 49, 51 by a screw 69 inserted from inside the bottom panel 23 and fixedly mounted on the escape panel 31 on each side 58, 59 of the escape panel 31. A T-shaped plunger lock 71 having a pointed end 73 is centrally mounted between the side members 58, 59 in the escape panel 31. The plunger lock 71 extends upwardly through a slot 72 in the top member 56 with its pointed end 73 forming an inclined surface 74 and engaging the bottom member 35 of the upper panel 29 in a recess 75.

The recess 75 is also pointed forming an inclined surface 76 which corresponds to the inclined surface 74. The T-shaped plunger lock 71 has an upper section 77 which is a rectangular plate. The lower section 79 tapers to an elongated bar 81 centrally located below the upper section 77. The elongated bar 81 has a forked end 82. A pair of coil springs 83 engage the underedge of the upper section 77 of the T-shaped plunger lock 71 on both sides of the lower section 79 and force the plunger lock 71 upwardly into the recess 75 in the bottom member 35 of the upper panel 29. A release bar 85 is pivotably mounted about a pivot pin 87 located adjacent the bottom end of the elongated bar 81. A slot 89 vertically oriented in the elongated bar 81 adjacent the forked end 82 of the elongated bar 81 engages a pin 91 fixedly mounted in the release bar 85 at the end of the release bar 85 adjacent the bottom end of the elongated bar. A coil spring 92 fixedly mounted at its upper end urges upwardly the end of the release bar 85 adjacent the spring 92 thereby lifting the pin 91 toward the top of the slot 89 in the elongated bar 81. A handle 93 is pivotably mounted on a pivot pin 94 held by two plates 95 located adjacent the opposite end of the release bar 85 from the spring 92. The handle 93 is bent approximately ninety degrees at its lower end where the pin 94 is located. The upper section of the handle 93 is vertically oriented and the lower section is substantially horizontally oriented. The end of the lower section farthest from the pin 94 engages the end of the release bar 85 remote from the coil spring 92. A notch 96 in the release bar 85 serves to hold the handle 93 in engagement with the release bar 85. Movement of the handle 93 outwardly forces the release bar 85 upwardly at the end where the handle 93 engages the release bar 85. This forces the end adjacent the elongated bar downwardly which pulls the plunger lock 71 downwardly against the force of the coil springs 83 and the coil spring 92. A breakable window panel 97 provides access to the handle 93. A unbreakable cover 98 mounted on hinges 99 at its lower edge covers the breakable glass 97. A latch 100 holds the cover 98 in place. The hinges 99 are designed to limit opening of the cover 98 so that upon opening of the escape panel 31, the unbreakable cover 98 will fall over to cover the opening formed by the breaking of the glass 97.

Figure 3:
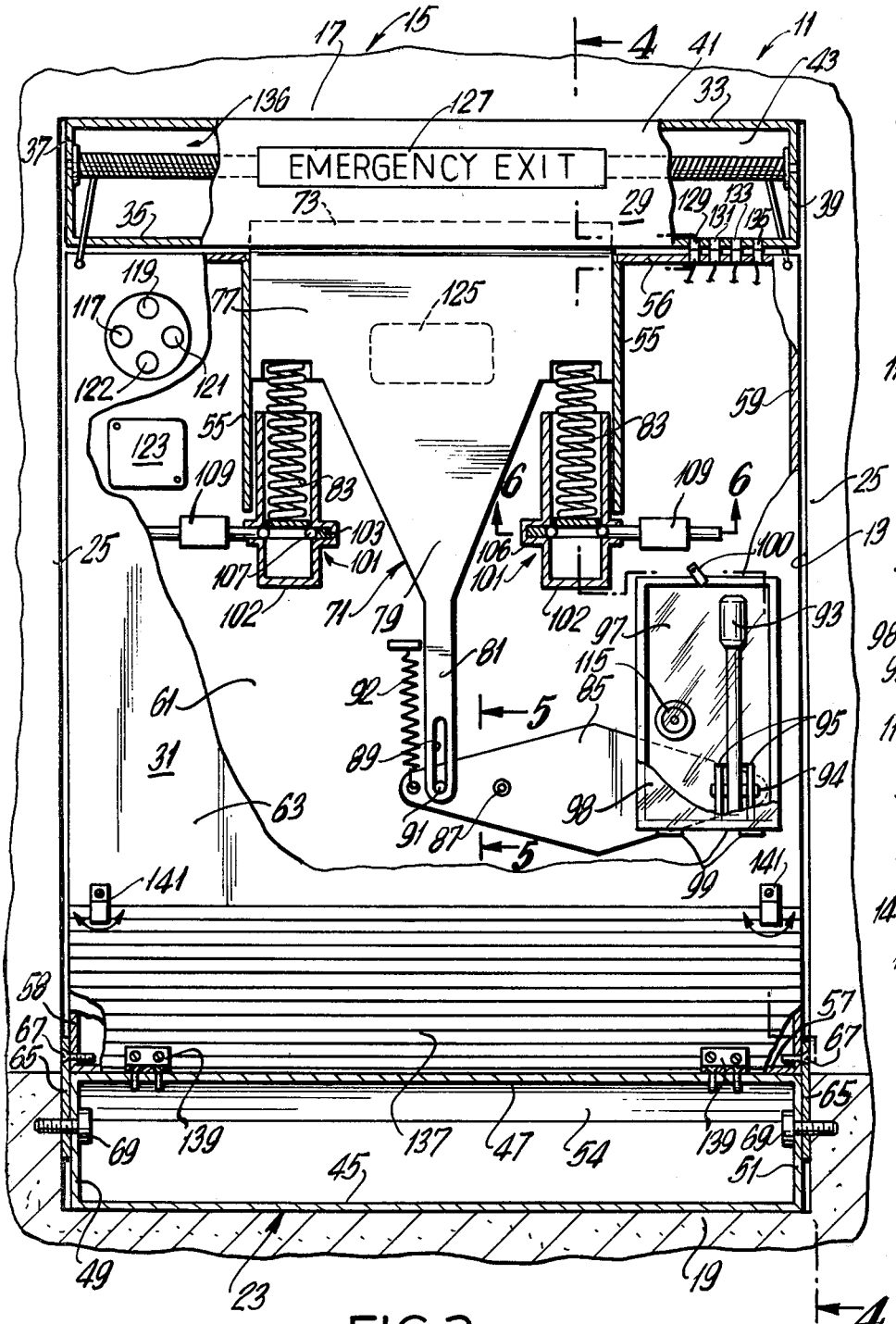
FIG. 3 is a front plan view of the emergency escape wall structure partially broken away to show the plunger lock with the supporting springs.
Figure 4:
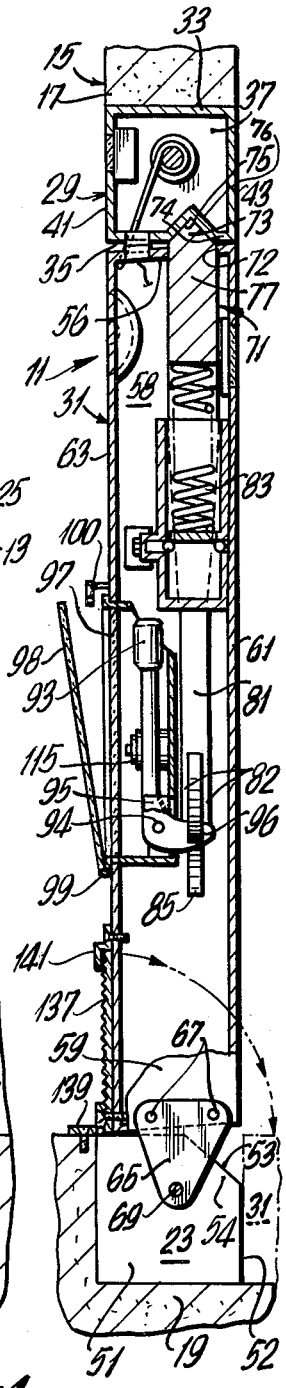
FIG. 4 is a cross-sectional view along lines 4—4 of FIG. 3.
Figure 5:
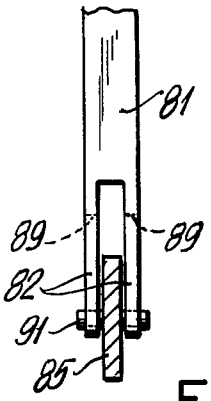
FIG. 5 is a cross-sectional view along lines 5—5 of FIG. 3.
Figure 6:
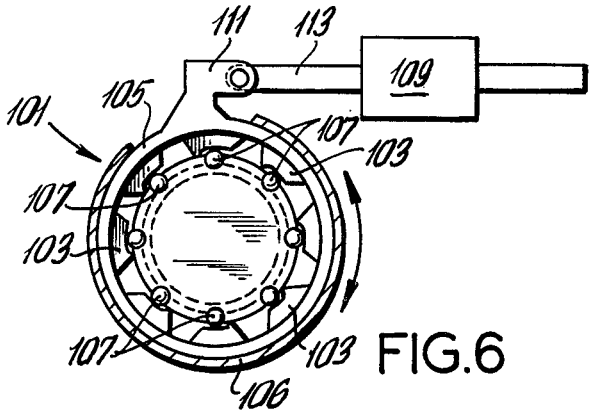
FIG. 6 is a cross-sectional view along lines 6—6 of FIG. 3.

The coil springs 83 are supported, as best seen in FIGS. 3 and 4, upon a retaining mechanism 101 over a well 102. The retaining mechanism 101 includes a series of teeth 103 located about the inner circumference of a rim or ring-shaped member 105 within a housing 106. The lower end of each coil spring 83 includes a plurality of lugs 107 secured to the base of each spring 83. When supported, the lugs 107, which are preferably sphere-shaped, rest on the teeth 103. When the ring-shaped member 105 is rotated, the lugs 107 pass between the teeth 103 and the springs 83 will drop downwardly into the well or container 102 under the coil springs 83. A pair of solenoids 109 are located adjacent the ring-shaped member 105. An extension 111 from the rim or ring-shaped member 105 of each retaining mechanism 101 is pivotably connected to the rod 113 of its respective solenoid 109. When the solenoids 109 are actuated, the rod 113 of each solenoid 109 moves outwardly against the extension 111 causing the ring-shaped member 105 to rotate thereby dropping the springs 83.

A push button 115 is provided and when depressed, the solenoids 109 are actuated. The push botton 115 is located behind the breakable glass or window panel 97 where the handle 95 is located. Another push botton 116 is remotely located for opening the door from an emergency control center (not shown) in the building. Similarly, a heat sensor 117, a smoke detector 119, a gas detector 121 and a oxygen deficiency detector 122 are provided. When either the heat sensor 117 or the smoke detector 119 or the gas detector 121 or the oxygen deficiency detector 122 are actuated or either the push button 115 or the push button 116 is pressed, the solenoids 109 will actuate causing the pair of coil springs 83 to drop. In the alternative, the handle 95 may be pulled out of the escape panel 31, forcing the plunger lock 71 downwardly thereby causing the escape panel 31 to open. A rechargable battery 123 is situated in the escape panel 31 to provide an electrical power source in the event of power failure. If everything fails, including manual operation of the escape panel 31, because of a combination of electrical failure and panic, the pressure of people against the escape panel 31 will force the plunger lock 71 to move downwardly thereby opening the escape panel 31. This is caused by the interaction between the inclined surfaces 74, 76 which results in a downward force on the plunger lock 71 opposed to the pair of coil springs 83 when there is outward pressure on the inside sheet 63 of the escape panel 31.

A sign 125 preferably entitled "Danger Break Away Wall" is located centrally in the escape panel 31 in the exterior side 61. In the inside sheet 41 of the upper panel another sign 127 is located preferably entitled "Emergency Exit".

Two contacts 129, 131 located near the upper right hand corner of the escape panel 31 provide electrical energy from a main power source to the escape panel 31 from the upper panel 29. The rechargable battery 123 is located within the escape panel 31 and power from the rechargable battery 123, when it is being utilized, it transmitted outside the escape panel 31 by two other contacts 133, 135. An electrical conduit 136 provides a passageway for electrical wiring in the upper panel 29.

Located at the base of the escape panel 31 on its inner surface 63 is a tread plate 137. The tread plate 137 is mounted on hinges 139 so as to be movable downward. A pair of latches 141 are provided to secure the tread plate 137. In this way the tread plate 137 can be swung over to provide a walkway up to the escape panel 31 so that the person leaving can move up across the lower panel 23 and down the escape panel 31.

Figure 7:
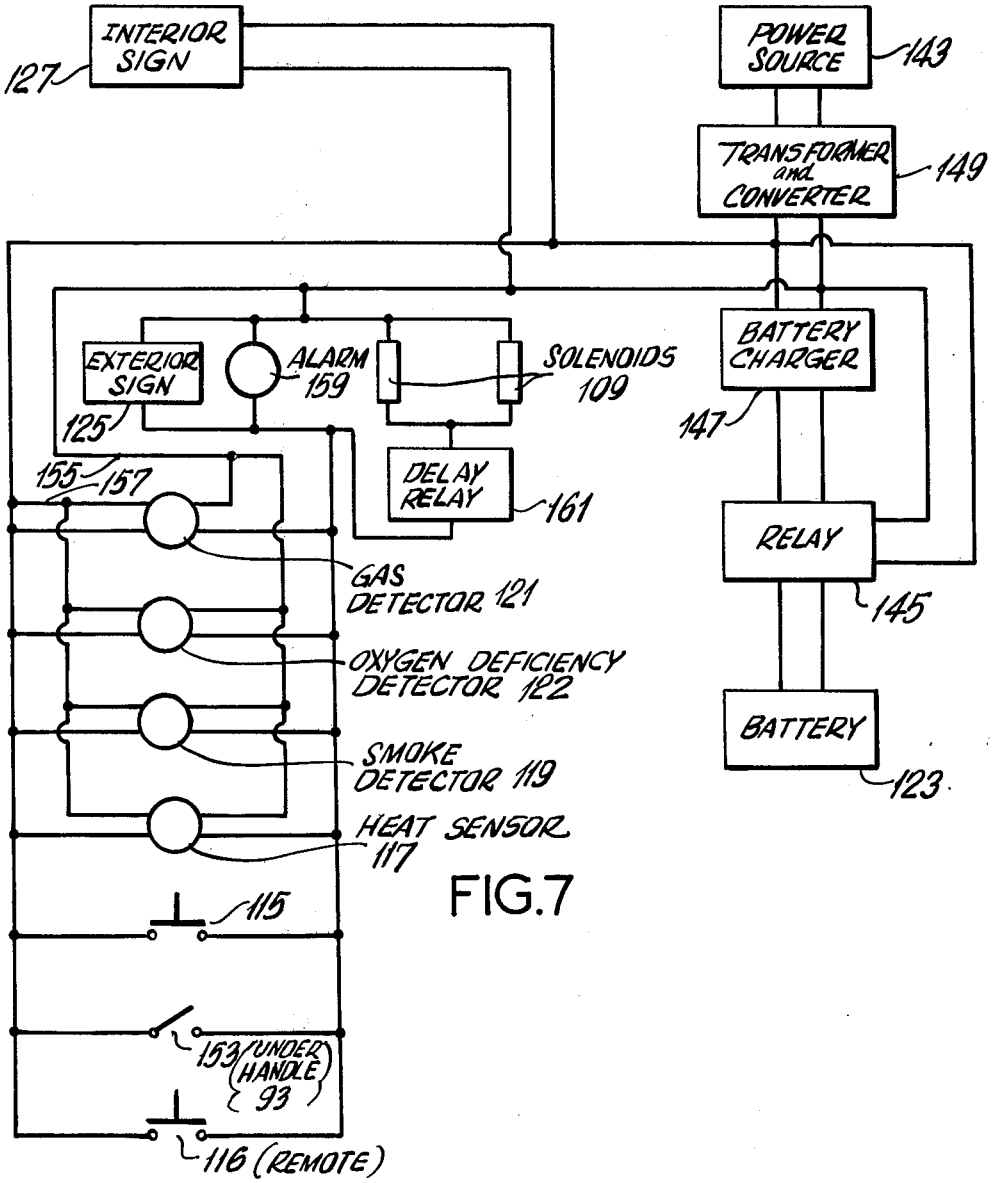
FIG. 7 is a schematic diagram of the electrical system used in conjuction with the emergency escape wall structure.

Referring to FIG. 7, the power may be supplied either from the power supply 143 or the rechargeable battery 123. The battery 123 is prevented from providing power because of a relay switch 145 which is held open by the availability of the normal power source 143. Upon failure of the main power source 143, the relay 145 in series with the battery 123 will close to prevent feed back to a battery charger 147 but will open to permit the flow of electrical power from the battery 123 directly to the circuit. Power from the power supply 143 is converted to direct current and reduced in voltage in a transformer-converter 149 before supplying the battery charger 147 which assures that the battery 123 is continuously charged.

Regardless of whether the battery 123 or the power source 143 is functioning, the circuit, in order to close, must have the gas detector 121, the oxygen deficiency detector 122, the smoke detector 119, the heat detector 117, the push button 115, the push button 116 or a switch 153 under the handle 93. Lines 155, 157 supply power to the detectors 117, 119, 121, 122 to operate them so that anyone of them can actuate the solenoids 109. An alarm 159 and the warning sign 125 upon detecting a situation in accordance with their functional purpose. Immediately, upon closing of the circuit, the sign 125 turns on and the alarm 159 rings. The alarm 159 is mounted outside near the escape panel 31 to warn that the escape panel 31 is opening. In parallel with the outside sign 125 are the solenoids 109. A delay relay 161, in series with solenoids 109, delay actuation of the solenoids for a brief period of time, five seconds to twenty seconds, so that persons hearing the alarm 159 and seeing the sign 125 will leave the immediate area to avoid being struck by the escape panel 31. The interior sign 127 is directly connected to either power source 123, 143 so as to be on at all times.

Examples of gas and smoke and heat detectors are shown in the following U.S. Patents:

| Inventor | Patent Number |
|---|---|
| Abe | 3,500,368 |
| Jensen | 3,447,152 |
| Jordan | 3,445,669 |
| Deuth | 3,430,220 |
| Vasel | 3,382,762 |

The invention may be embodied in other specific forms without departing from the spirit or essential characteristics thereof. The present embodiments are, therefore, to be considered in all aspects as illustrative and not restrictive. The scope of the invention being indicated by the appendant claims rather than the foregoing description and all changes which come within the meaning and range of equivalence of the claims are therefore, intended to be embraced therein.

I claim:

1. An emergency escape wall structure situated between two side frames, a header frame and a sill frame, said structure comprising:

a top panel rigidly mounted between the two side frames and the head frame, said top panel having a bottom member with a recess therein;

a bottom panel rigidly mounted between the two side frames and the sill frame;

an escape panel having an inside sheet and having a top member with a slot therein, said slot being aligned with the recess in the bottom member of the top panel, said escape panel having a lower edge adjacent said bottom panel;

hinge means mounted at the lower edge of the escape panel for pivotably mounting said escape panel between said side frames and said top panel and said bottom panel, said hinge means being adapted to permit said escape panel to pivot outwardly and downwardly;

a plunger lock slidably mounted within said escape panel to move in and out through the slot in the top member of the escape panel into the recess of the bottom member of the top panel;

spring means engaging said plunger lock and adapted to urge said plunger lock through said slot into said recess, said plunger lock having an inclined surface and said recess having a corresponding inclined surface whereby pressure on the inside sheet of the escape panel causes a downward force on the plunger lock opposed to the spring means; and means for releasing the force of said spring means to cause said plunger lock to drop out of said recess.

2. An emergency escape wall structure according to claim 1 further including a lever means engaging said plunger lock to force said plunger lock out of said recess against the force of said spring means.

3. An emergency escape wall structure according to claim 1 wherein said plunger lock is T-shaped having an upper rectangularly shaped section and a lower extension extending downwardly therefrom.

4. An emergency escape wall structure according to claim 2 wherein said spring means engaging said plunger lock includes a pair of coil springs pressing upwardly against said upper rectangularly-shaped section.

5. An emergency escape wall structure according to claim 1 wherein said means for releasing the force of said spring means includes:

a pair of containers, each located beneath one of said pair of coil springs, each container having an open top;

a pair of ring-shaped members each rotatably mounted on top of one of said pair of containers, each ring-shaped member having a teeth about its interior circumference, each coil spring having lugs affixed to its lower end, said lugs resting on said teeth;

means for rotating said ring-shaped members whereby said extensions are released from said teeth about the interior circumference.

6. An emergency escape wall structure according to claim 5 wherein said means for rotating said ring-shaped members includes a pair of solenoids.

7. An emergency escape wall structure according to claim 6 wherein said solenoids are actuated by a detecting means.

8. An emergency escape wall structure according to claim 2 wherein said lever means for engaging said plunger lock includes:

a bar pivotably mounted within said escape panel, one end of said bar slidably engaging the lower extension of the plunger lock; and a handle pivotably engaging said bar, the longitudinal axis of said bar and the longitudinal axis of said handle are substantially at right angles to one another.

9. An emergency escape wall structure according to claim 1 wherein said plunger lock has a pointed top surface.

10. An emergency escape wall structure according to claim 1 wherein said means for releasing the force of said spring means includes:

a detecting means; and a solenoid means actuated by said detecting means.

* * * * *

UNITED STATES PATENT AND TRADEMARK OFFICE

CERTIFICATE OF CORRECTION

PATENT NO. : 4,164,095

DATED : August 14,1979

INVENTOR(S) : John Musacchia

It is certified that error appears in the above—identified patent and that said Letters Patent is hereby corrected as shown below:

Column 2, line 36, delete the first word "The" and and insert -- At the --.

Column 2, line 61, after "panel" insert the numeral -- 31 --.

Column 3, line 36, after "elongated bar" insert the numeral -- 81 --.

Column 4, line 60 delete "downward" and insert in its place -- downwardly --.

Column 5, line 14 after "must have" insert -- in operation --.

Column 5, line 21 after "situation" insert -- operate --.

Column 5, line 27 after "solenoids 109" change "delay" to -- delays --.

Column 6, line 23 (Claim 3, line 3) between "rectangularly" and "shaped" insert a hyphen.

UNITED STATES PATENT AND TRADEMARK OFFICE

CERTIFICATE OF CORRECTION

PATENT NO. : 4,164,095 Page 2 of 2

DATED : August 14, 1979

INVENTOR(S) : John Musacchia

It is certified that error appears in the above—identified patent and that said Letters Patent is hereby corrected as shown below:

Column 6, line 26, claim 4, line 2 delete the numeral "2" and insert in its place the numeral -- 3 --.

Signed and Sealed this

*Twelfth* Day of *August 1980*

[SEAL]

*Attest:*

SIDNEY A. DIAMOND

*Attesting Officer* *Commissioner of Patents and Trademarks*